US011491512B2

(12) United States Patent
Jackson et al.

(10) Patent No.: US 11,491,512 B2
(45) Date of Patent: Nov. 8, 2022

(54) SYSTEMS AND METHODS FOR CLEANING SHALE SHAKERS

(71) Applicant: Halliburton Energy Services, Inc., Houston, TX (US)

(72) Inventors: Brice Aaron Jackson, Houston, TX (US); Andrew David Vos, Spring, TX (US); Daniel Reynold Robichaud, Humble, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 344 days.

(21) Appl. No.: 16/880,115

(22) Filed: May 21, 2020

(65) Prior Publication Data

US 2021/0362192 A1 Nov. 25, 2021

(51) Int. Cl.

| | |
|---|---|
| ***B07B 1/55*** | (2006.01) |
| ***E21B 21/06*** | (2006.01) |
| ***B07B 1/28*** | (2006.01) |
| ***F26B 17/26*** | (2006.01) |
| ***F26B 5/12*** | (2006.01) |

(52) U.S. Cl.

CPC ..... *B07B 1/55* (2013.01); *B07B 1/28* (2013.01); *E21B 21/065* (2013.01); *F26B 5/12* (2013.01); *F26B 17/26* (2013.01)

(58) Field of Classification Search

CPC .. B07B 1/28; B07B 1/55; B07B 13/16; E21B 21/065; F26B 5/12; F26B 17/26

See application file for complete search history.

(56) References Cited

U.S. PATENT DOCUMENTS

| | | | | |
|---|---|---|---|---|
| 5,814,230 | A * | 9/1998 | Willis | B01D 33/333 210/384 |
| 2005/0183994 | A1* | 8/2005 | Hensley | B07B 13/16 209/11 |
| 2008/0078700 | A1* | 4/2008 | Jones | B07B 1/55 209/269 |
| 2011/0284481 | A1 | 11/2011 | Pomerleau | |
| 2016/0090799 | A1 | 3/2016 | Geehan et al. | |
| 2016/0356108 | A1 | 12/2016 | Kutryk | |
| 2018/0353997 | A1 | 12/2018 | Frazier | |
| 2019/0054406 | A1 | 2/2019 | Johnson et al. | |

FOREIGN PATENT DOCUMENTS

KR 10-2018-0105789 10/2018

OTHER PUBLICATIONS

MudCube, A modern, safer and lower cost solution for primary solids control, Cubility, 2012.

GN Solids Control—Vertical Cuttings Dryer.

International Search Report and Written Opinion for Application No. PCT/US2020/035661 dated Dec. 8, 2020.

* cited by examiner

*Primary Examiner* — Michael Mccullough

*Assistant Examiner* — Kalyanavenkateshware Kumar

(74) *Attorney, Agent, or Firm* — Tenley Krueger; C. Tumey Law Group PLLC

(57) ABSTRACT

An apparatus may include: a shaker body; a shaker screen disposed within the shaker body; and one or more air nozzles disposed within the shaker body, wherein the one or more air nozzles is positioned below the shaker screen, and wherein the one or more air nozzles is operable to deliver a pressurized stream of air to at least a portion of a bottom of the shaker screen.

20 Claims, 5 Drawing Sheets

SYSTEMS AND METHODS FOR CLEANING SHALE SHAKERS

BACKGROUND

During the drilling of a hydrocarbon-producing well, a drilling fluid or "mud" is continuously circulated from a surface location down to the bottom of the wellbore being drilled and back to the surface again. The drilling fluids perform a number of functions, including lubricating the area being drilled and removing any cuttings that are created during the drilling operations. The returning drilling fluid includes drill cuttings derived primarily from the formation being penetrated by a drill bit. In the case of multilateral wells, the drill cuttings may also include metal drill cuttings generated from milling or drilling through casing walls to form a lateral wellbore. Some downhole operations can also include borehole reaming operations, which can result in a unique type of cuttings returning to surface. When the drilling fluids are returned to the surface, they may be directed to a shale shaker to remove drill cuttings and other solids from the drilling fluid and to recover the drilling fluid for reintroduction into the wellbore. Shale shakers typically include vibrating screens with sized perforations that allow the drilling fluid to pass through while leaving the drill cuttings and other solids behind.

Shale shakers are generally not able to remove all the drilling fluid from drill cuttings and cuttings will still be wet when leaving the vibrating screens. Further there may be operational challenges associated with shale shakers including screen blinding and screen damage that may reduce the amount of drilling fluid recovered in a shale shaker or reduce the solid s removal efficiency of the shale shaker.

BRIEF DESCRIPTION OF THE DRAWINGS

These drawings illustrate certain aspects of the present disclosure, and should not be used to limit or define the disclosure.

DETAILED DESCRIPTION

The present disclosure is related to wellbore drilling operations and, more particularly, to methods and systems are provided for enhanced removal of drilling fluids from drill cuttings in shale shakers. Further methods and systems may include detection of solids passthrough and remediation of screen blinding.

Figure 1:
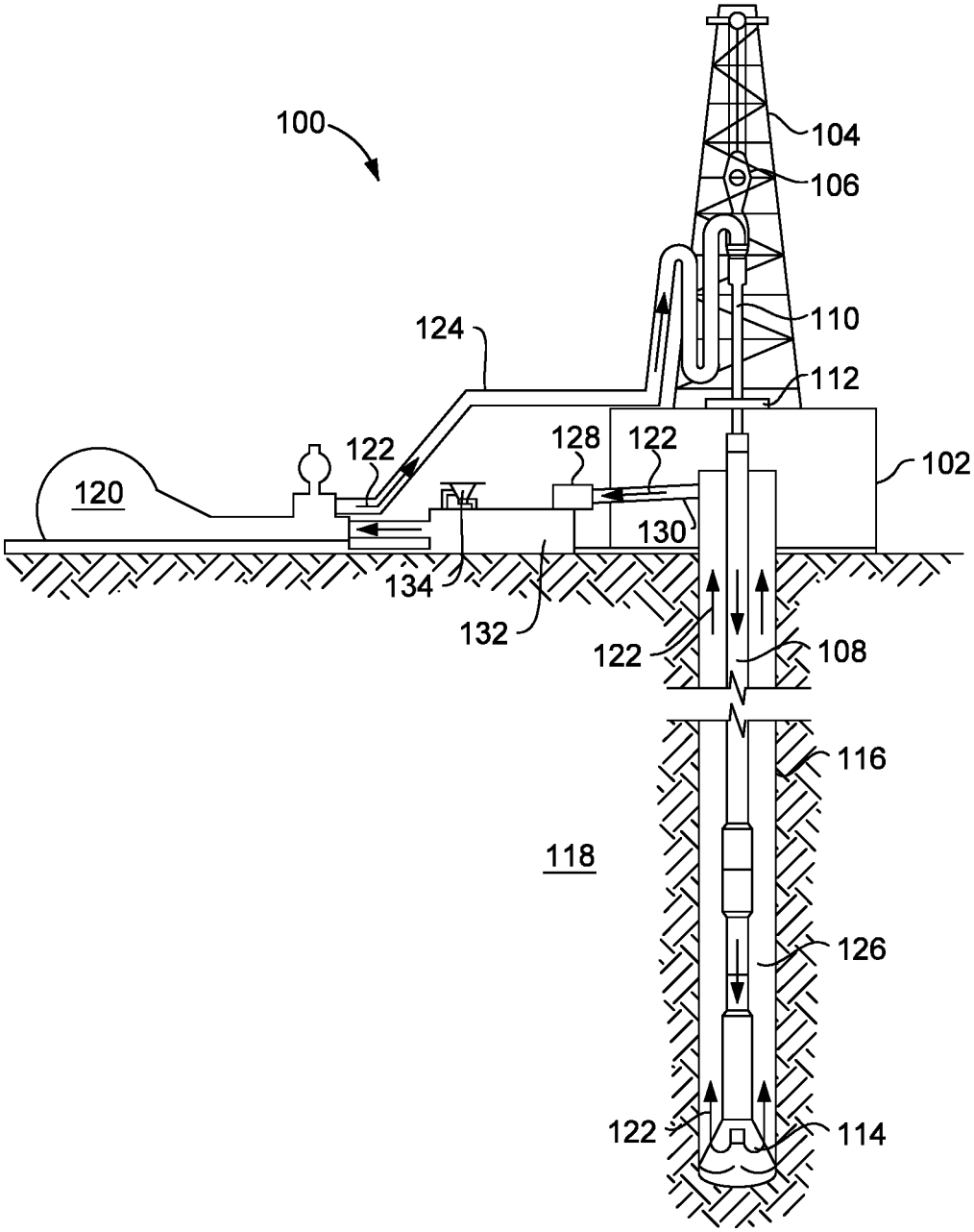
FIG. 1 is a schematic diagram of an exemplary drilling system that may employ the principles of the present disclosure.

Referring to FIG. 1, illustrated is an exemplary drilling system 100 that may employ the principles of the present disclosure, according to one or more embodiments. It should be noted that while FIG. 1 generally depicts a land-based drilling assembly, the principles described herein are equally applicable to subsea drilling operations that employ floating or sea-based platforms and rigs, without departing from the scope of the disclosure. As illustrated, the drilling system 100 may include a drilling platform 102 that supports a derrick 104 having a traveling block 106 for raising and lowering a drill string 108. The drill string 108 may include, but is not limited to, drill pipe or coiled tubing, as generally known to those skilled in the art. A kelly 110 supports the drill string 108 as it is lowered through a rotary table 112. A drill bit 114 is attached to the distal end of the drill string 108 and is driven either by a downhole motor and/or via rotation of the drill string 108 by the rotary table 112. As the bit 114 rotates, it creates a borehole 116 that penetrates various subterranean formations 118. A pump 120 (e.g., a mud pump) circulates drilling fluid 122 through a feed pipe 124 and to the kelly 110, which conveys the drilling fluid 122 downhole through the interior of the drill string 108 and through one or more orifices in the drill bit 114. The drilling fluid 122 is then circulated back to the surface via an annulus 126 defined between the drill string 108 and the walls of the borehole 116. At the surface, the recirculated or spent drilling fluid 122 exits the annulus 126 and may be conveyed to one or more fluid processing units, such as solids control equipment 128 via an interconnecting flow line 130. The returning or spent drilling fluid 122 may contain cuttings and debris derived from the borehole 116 as the drill bit 114 grinds and scrapes the bottom and walls of the borehole 116. The spent drilling fluid 122 may also contain various solid additives, such as lost circulation materials and weighting agents, added to the drilling fluid 122 to enhance its operation. After passing through the fluid processing units, including the solids control equipment 128, a "cleaned" drilling fluid 122 may be deposited into a nearby retention pit 132 (i.e., a mud pit or suction tank). One or more chemicals, fluids, or additives may be added to the drilling fluid 122 via a mixing hopper 134 communicably coupled to or otherwise in fluid communication with the retention pit 132. The solids control equipment 128 may be configured to substantially remove drill cuttings, solids, and other unwanted debris from the drilling fluid 122 and thereby separate waste from reusable particulates or materials. The solids control equipment 128 may include one or more of shakers (e.g., shale shaker). To remove drill cuttings and other unwanted solids from the returning drilling fluid 122, shakers used in the solids control equipment 128 may include one or more shaker screens (not shown) across which the drill cuttings may traverse to be separated from the drilling fluid 122.

A common problem encountered with solids control equipment 128 such as shale shakers is the inefficient removal of fluids. For example, even when shakers are properly tuned, they may still pass a volume of drilling fluid to the cuttings box (not illustrated), thereby removing the drilling fluid from the fluid circuit and contributing to the loss of drilling fluid in the drilling operation. A cuttings box or other storage medium may be used to store drill cuttings for disposal or reuse. Drilling fluids may be adsorbed on drill cuttings and the adsorbed fluid may not be completely removed vibration on the shaker screen. Thus, any volume of drilling fluid adsorbed on drill cuttings may be lost when the solids are dumped to the cuttings box. Drilling fluid may also be lost when a shaker screen is obstructed such as when solids are plugging the pores of the screen, a condition which may be referred to as screen blinding. When screen blinding occurs, fluid that would normally pass through the screen may be directed off the screen and to the cuttings box thereby removing the drilling fluid from the fluid circuit. Screen blinding may require shut down of the shaker to replace the shaker screens or power washing to remove plugging solids, both of which contribute to non-productive time of a drilling operations. In addition to fluid loss, other conditions such as solids retention caused by solids passing through a broken shaker screen may occur. The solids not removed may affect the properties of the drilling fluid rendering it less suitable for use in drilling the wellbore.

Figure 2A:
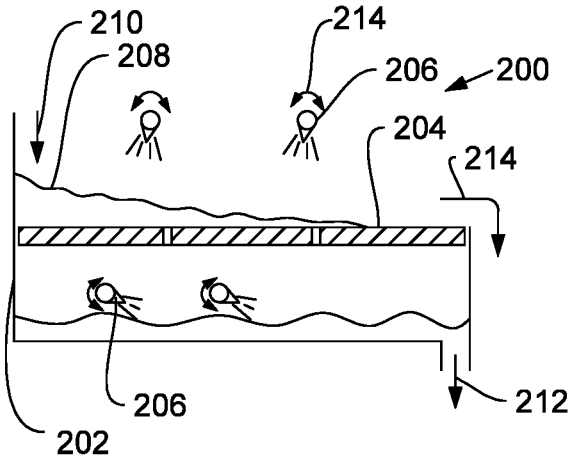
FIG. 2*a* is a schematic diagram of a side profile of a shaker.

Referring to FIG. 2*a*, a side profile of shaker 200 is illustrated. Shaker 200 may include a shaker body 202 which may contain the drilling fluids introduced into shaker 200. Drilling fluid 208 may be introduced into shaker 200 as shown by arrow 210 which may then accumulate on shaker screen 204. Solids may be separated from drilling fluid 208 as drilling fluid 208 flows through perforations on shaker screen 204. Shaker screen 204 may be coupled to a shaking system (not shown) which may include motors operable to provide mechanical shaking motion to shaker screen 204. The vibrating motion of shaker screen 204 may aid in separation of solids from drilling fluid 208 as drilling fluid 208 traverses shaker screen 204. Solids separated may traverse across shaker screen 204 and exit shaker body 202 as shown by arrow 214. Drilling fluid 208 may collect below shaker screen 204 and exit shaker body 202 as indicated by arrow 212. As illustrated, a plurality of air nozzles 206 may be positioned within shaker body 202, optionally above and below shaker screen 204. Air nozzles 206 positioned above shaker screen 204 may be operable to provide pressurized air to aid in separation of the solids from drilling fluid 208. The plurality of air nozzles 206 positioned above shaker screen 204 may be operable to provide a sufficient flow rate and pressure of air to remove at least a portion of drilling fluid adsorbed on solids and forcibly blow drilling fluid 208 through shaker screen 204. Air nozzles 206 positioned below shaker screen 204 may be operable to provide a sufficient flow rate and pressure of air to blow drilling fluid out of shaker body 202 as indicated by arrow 214. Air nozzles 206 may be further configured to pivot as indicated by arrow 214 such that air may be blown at any desired angle of attack relative to shaker screen 204. Although not illustrated in FIG. 2*a*, air nozzles 206 may be fluidically connected to the potion of shaker body 202 below shaker screen 204 by way of a venturi, thereby providing a vacuum beneath shaker screen 204 to further promote separation of drilling fluid from solids.

Figure 2B:
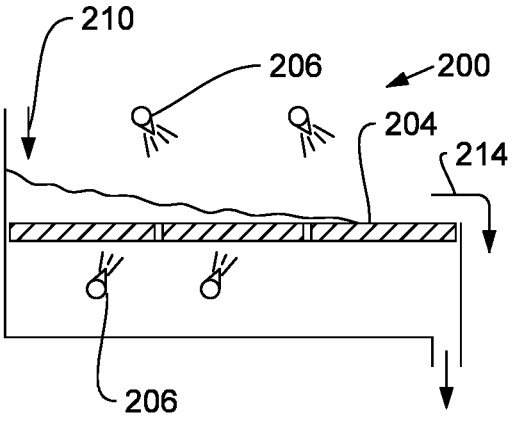
FIG. 2*b* is a schematic diagram of a side profile of a shaker.

Referring to FIG. 2*b*, a side profile of shaker 200 is illustrated. In FIG. 2*b* air nozzles 206 disposed below shaker screen 204 are turned to blow air up through shaker screen. In this configuration air may be used to dislodge solids that are plugged in perforations on shaker screen 204 thereby allowing the solids to traverse shaker screen 204 and out of shaker body 202 as indicated by arrow 214. Air nozzles 206 disposed above and below shaker screen 204 may pivot forward and back across shaker screen 204 such that the air nozzles may clear solids across the entirety of shaker screen 204. In configurations where shaker 200 has a control system, an automated cleaning routine may be run where air nozzles 206 are selectively pivoted such that air is directed to clear solids on shaker screen 204. Such cleaning routines may be toggled on and off to maintain fluid throughput through the screen versus screen cleanliness, for example.

Figure 2C:
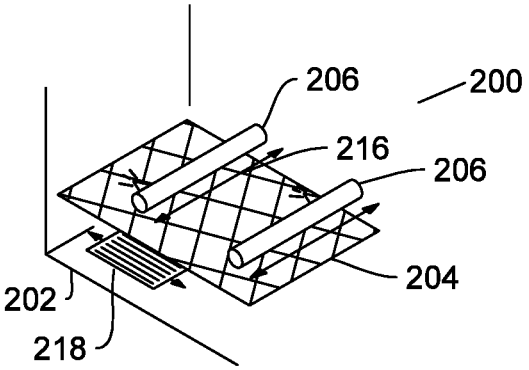
FIG. 2*c* is a schematic diagram of a top profile of a shaker.

Referring to FIG. 2*c*, a top profile of shaker 200 is illustrated. As illustrated in FIG. 3*c*, air nozzles 206 are operable to move left and right as indicated by arrow 216 to allow air to be directed to any location on shaker screen 204. Further illustrated in FIG. 3*c* sensor 218 disposed below shaker screen 204. Sensor 218 may be maneuverable and position able within shaker body 202. Sensor 218 may be any sensor capable of measuring fluid recovery performance. Some sensors may include, without limitation, load cells or force transducers. Sensor 218 may generate a signal which may be interpreted or correlated to a performance or health indicator of shaker screen 204. For example, a stable signal may indicate that fluid is passing through shaker screen 204 at a steady rate and the screen is performing correctly. A saturated signal or high signal may indicate that solids are passing through the screen whereas a null signal may indicate that little to fluid is passing through the screen.

Figure 2D:
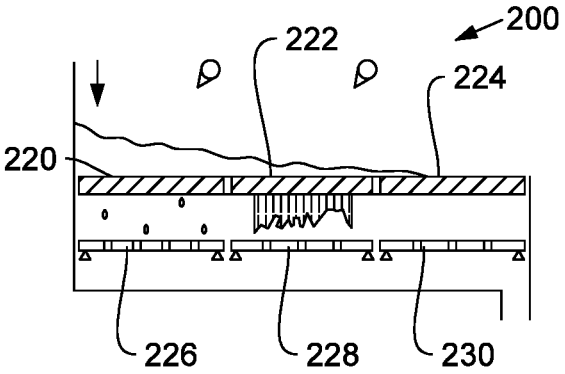
FIG. 2*d* is a schematic diagram of a side profile of a shaker illustrating various fluid conditions.

Referring to FIG. 2*d*, a side profile of shaker 200 is illustrated. In FIG. 2*d* the three signal conditions are illustrated. A steady fluid flow condition is shown in screen section 220 and sensor 226 would returns a steady signal. In screen section 222, a screen flooding condition is illustrated where a majority of the solids and fluids are passed through the screen to sensor 228. In such a condition, sensor 228 may return a saturated signal. Screen section 224 shows a screen blinding condition where solids and liquids are minimally passed through screen section 224. In a screen blinding condition sensor 230 may return a null signal.

When a screen condition such as screen blinding has occurred, a control system may begin a screen operation such as a cleaning routine as discussed above to clear solids trapped on the screen surface. Further, shaker 200 may include a plurality of sensors 218 disposed within shaker body 202 such that the screen condition may be monitored at different points on the screen. A control system may monitor a signal from each of the plurality of sensors which may allow the condition of the screen surface to be monitored. In the instance where only a portion of the screen is subjected to screen blinding, for example, the control system may detect a null signal or a decreased signal from a sensor positioned below the portion of screen that is blinded. In this way the control system may detect which section of the screen requires remediation and thereby selectively maneuver one or more of the air nozzles 206 to clear the portion of the screen that is subjected to screen blinding without affecting the separation of drilling fluid and solids on other portions of the screen.

While the previous discussion has been directed to air nozzles, any suitable pneumatic device may substitute for air nozzles. For example, and without limitation other suitable pneumatic devices may include air knives. Further, while referred to above as utilizing air, any suitable gas source may be used in the pneumatic device, including, but not limited to, air, nitrogen, carbon dioxide, engine exhaust gasses, or any other suitable gasses.

Figure 3:
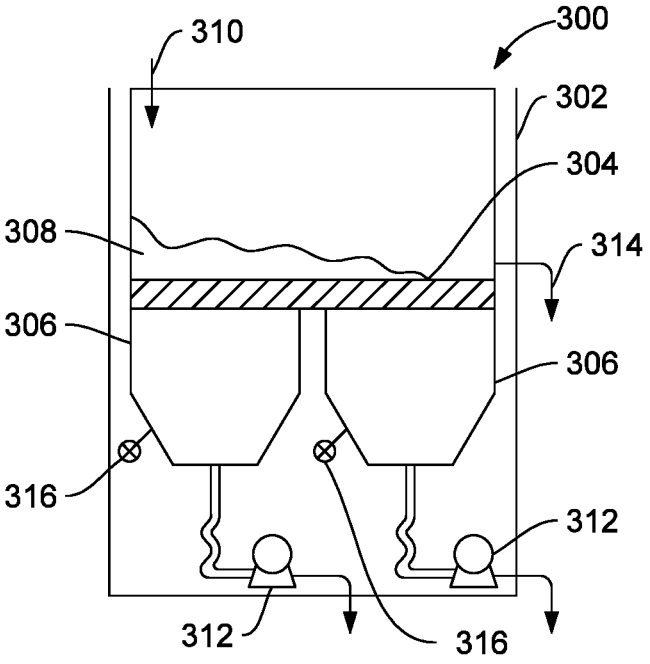
FIG. 3 is a schematic diagram of a side profile of a shaker.

With reference to FIG. 3, a side view of shaker 300 is illustrated. Shaker 300 may include a shaker body 302 which may contain the drilling fluids introduced into shaker 300. Drilling fluid 308 may be introduced into shaker 300 as shown by arrow 310 which may then accumulate on shaker screen 304. Solids may be separated from drilling fluid 308 as drilling fluid 308 flows through perforations on shaker screen 304. Shaker screen 304 may be coupled to a shaking system (not shown) which may include motors operable to provide mechanical shaking motion to shaker screen 304. The vibrating motion of shaker screen 304 may aid in separation of solids from drilling fluid 308 as drilling fluid 308 traverses shaker screen 304. Solids separated may traverse across shaker screen 304 and exit shaker body 302 as shown by arrow 314. Shaker 300 may include one or more fluid chutes 306 which may be fluidically connected to shaker screen 304 such that drilling fluid that passes through shaker screen 304 is directed into the one or more fluid chutes 306. Shaker 300 may further include one or more pumps 312 which may be fluidically connected to fluid chute 306. Pump 312 may be any suitable pump including, without limitation, a self-priming positive displacement pump or a flooded inlet centrifugal pump. Pump 312 may generate a vacuum below shaker screen 304 such that drilling fluid is drawn through shaker screen 304. While two fluids chutes and pumps are illustrated in FIG. 3, any number of fluid chutes and pumps may be utilized. Further, two or more fluid chutes and/or pumps may be used to provide vacuum to different sections of shaker screen 304. A pressure sensor 316 may be disposed in a manner operable to measure a pressure within fluid chute 316. Pressure sensor 316 may provide a signal to a control system, not illustrated, such that the operation of pump 312 may be regulated. In the instance where two or more pumps are utilized, the pumps may be independently controlled to provide different vacuum pressures across different sections of shaker screen 304. Pressure sensor 316 may also be used to provide feedback to monitor the condition of shaker screen 304 for screen stalls and screen blinding due to solids covering perforations on shaker screen 304.

Figure 4:
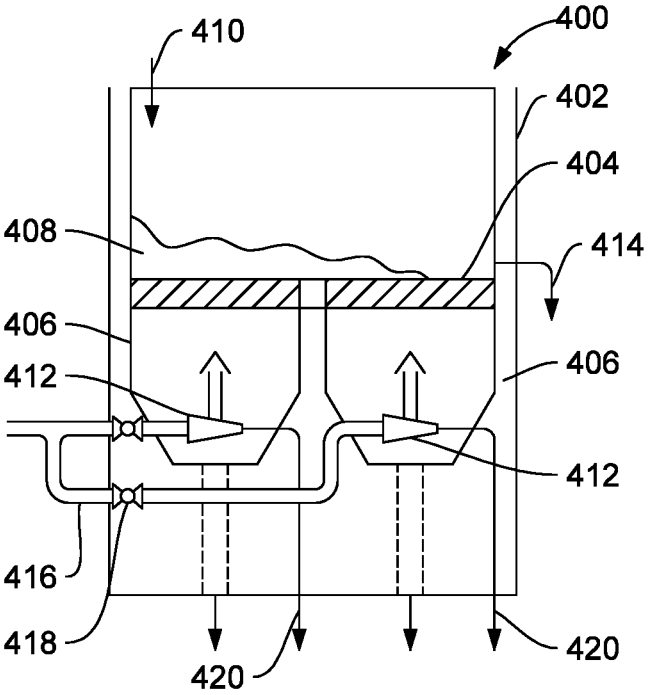
FIG. 4 is a schematic diagram of a side profile of a shaker.

With reference to FIG. 4, a side view of shaker 400 is illustrated. Shaker 400 may include a shaker body 402 which may contain the drilling fluids introduced into shaker 400. Drilling fluid 408 may be introduced into shaker 400 as shown by arrow 410 which may then accumulate on shaker screen 404. Solids may be separated from drilling fluid 408 as drilling fluid 408 flows through perforations on shaker screen 404. Shaker screen 404 may be coupled to a shaking system (not shown) which may include motors operable to provide mechanical shaking motion to shaker screen 404. The vibrating motion of shaker screen 404 may aid in separation of solids from drilling fluid 408 as drilling fluid 408 traverses shaker screen 404. Solids separated may traverse across shaker screen 404 and exit shaker body 402 as shown by arrow 414. Shaker 400 may include one or more fluid chutes 406 which may be fluidically connected to shaker screen 404 such that drilling fluid that passes through shaker screen 404 is directed into the one or more fluid chutes 406. Shaker 400 may further include one or more venturis 412 operable to generate a vacuum below shaker screen 404 such that drilling fluid is drawn through shaker screen 404. The venturis 412 may be coupled to a source of compressed gas through conduit 416. The compressed gas may be any source of gas including, but not limited to, air, nitrogen, carbon dioxide, engine exhaust gasses, or any other suitable gasses. The flow of compressed gas to the venturis 412 may be regulated by valve 418 such that the amount of vacuum generated by venturis 412 may be controlled. The compressed gas may exit venturis 412 as shown by arrow 420. While two fluids chutes and venturis are illustrated in FIG. 4, any number of fluid chutes and venturis may be utilized. Further, two or more fluid chutes and/or venturis may be used to provide vacuum to different sections of shaker screen 404. A pressure sensor, not illustrated, may be disposed in a manner operable to measure a pressure within fluid chute 406. Pressure sensors may provide a signal to a control system, not illustrated, such that the control system may regulate the flow of compressed gas to venturis 412 by controlling valve 418. In the instance where two or more venturis are utilized, the venturis may have corresponding valves which may be independently controlled to provide different vacuum pressures across different sections of shaker screen 404. Pressure sensors may also be used to provide feedback to monitor the condition of shaker screen 404 for screen stalls and screen blinding due to solids covering perforations on shaker screen 404.

Figure 5A:
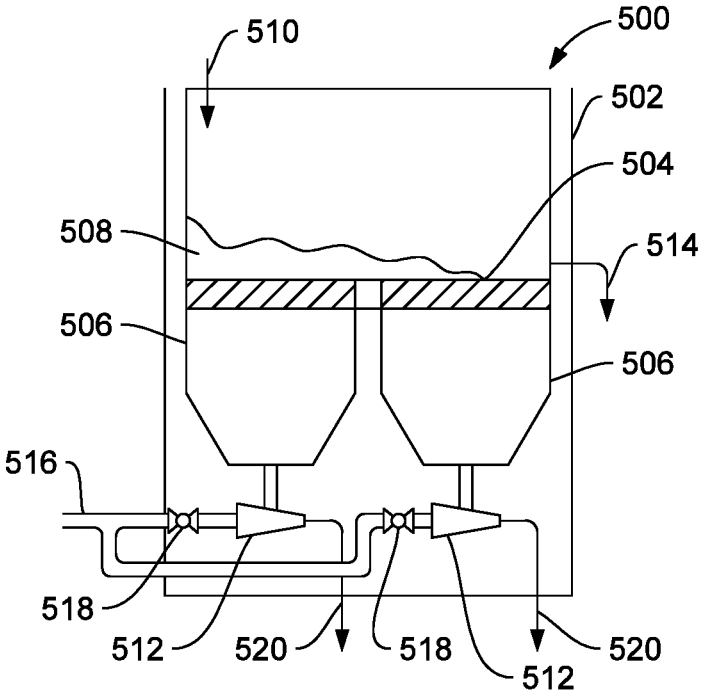
FIG. 5*a* is a schematic diagram of a side profile of a shaker.

With reference to FIG. 5*a*, a side view of shaker 500 is illustrated. Shaker 500 may include a shaker body 502 which may contain the drilling fluids introduced into shaker 500. Drilling fluid 508 may be introduced into shaker 500 as shown by arrow 510 which may then accumulate on shaker screen 504. Solids may be separated from drilling fluid 508 as drilling fluid 508 flows through perforations on shaker screen 504. Shaker screen 504 may be coupled to a shaking system (not shown) which may include motors operable to provide mechanical shaking motion to shaker screen 504. The vibrating motion of shaker screen 504 may aid in separation of solids from drilling fluid 508 as drilling fluid 508 traverses shaker screen 504. Solids separated may traverse across shaker screen 504 and exit shaker body 502 as shown by arrow 514. Shaker 500 may include one or more fluid chutes 506 which may be fluidically connected to shaker screen 504 such that drilling fluid that passes through shaker screen 504 is directed into the one or more fluid chutes 506. Shaker 500 may further include one or more eductors 512 operable to generate a vacuum below shaker screen 504 such that drilling fluid is drawn through shaker screen 504. The eductors 512 may be coupled to a source of pressurized liquid through conduit 516. The pressurized liquid may be any suitable liquid such as drilling fluid, for example. The flow of pressurized liquid to the eductors 512 may be regulated by valve 518 such that the amount of vacuum generated by eductors 512 may be controlled. The pressurized fluid and drilling fluid drawn through shaker screen 504 may exit eductors 512 as shown by arrow 520. While two fluids chutes and eductors are illustrated in FIG. 5*a*, any number of fluid chutes and eductors may be utilized. Further, two or more fluid chutes and/or eductors may be used to provide vacuum to different sections of shaker screen 504. A pressure sensor, not illustrated, may be disposed in a manner operable to measure a pressure within fluid chute 506. Pressure sensors may provide a signal to a control system, not illustrated, such that the control system may regulate the flow of pressurized fluid to eductors 512 by controlling valve 518. In the instance where two or more venturis are utilized, the venturis may have corresponding valves which may be independently controlled to provide different vacuum pressures across different sections of shaker screen 504. Pressure sensors may also be used to provide feedback to monitor the condition of shaker screen 504 for screen stalls and screen blinding due to solids covering perforations on shaker screen 504.

Figure 5B:
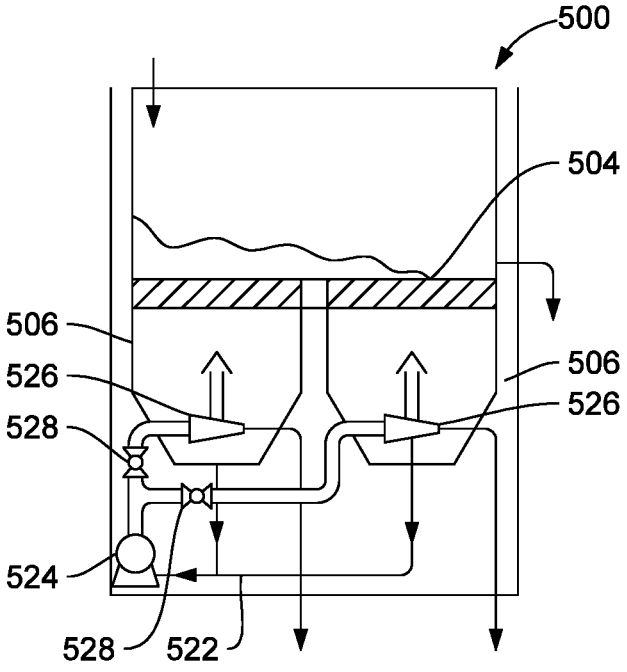
FIG. 5*b* is a schematic diagram of a side profile of a shaker.

FIG. 5*b* is an alternate embodiment of FIG. 5*a* whereby the compressed pressurized liquid is provided by a pump that is internal to shaker 500. As illustrated in FIG. 5*a*, flow line 522 may be fluidically coupled to fluid chute 506 and an inlet of pump 524 to draw drilling fluid from fluid chute 506. Pump 524 may be fluidically coupled to eductor 526 and provide pressurized liquid to eductor 526 thereby generating a vacuum below shaker screen 504. The flow of pressurized liquid to the eductors 526 may be regulated by valve 528 such that the amount of vacuum generated by eductors 526 may be controlled.

In each of FIGS. 3-5*b*, a vacuum may be generated below the shaker screen by vacuum generator that is internal to the shaker body. Further, in each of FIGS. 3-5*b* the vacuum generated may be regulated, including being switched off, such that solids binding to the shaker screen is reduced or eliminated. The use of sensors such as pressure sensors, for example, allows for the detection of screen stalls and blinding which may be remediated by cycling vacuum to the portion of the screen experiencing screen stall or blinding. Further a pressure sensor may be used to detect screen failure which may be seen as a loss of vacuum pressure. Thus, the screen condition may be readily monitored and a screen operation may be performed when a screen condition such as blinding, stalling, or failure has occurred. A screen operation may be any operations such as reducing vacuum to a portion of shaker screen experiencing the blinding, stalling, or failure.

Figure 6:
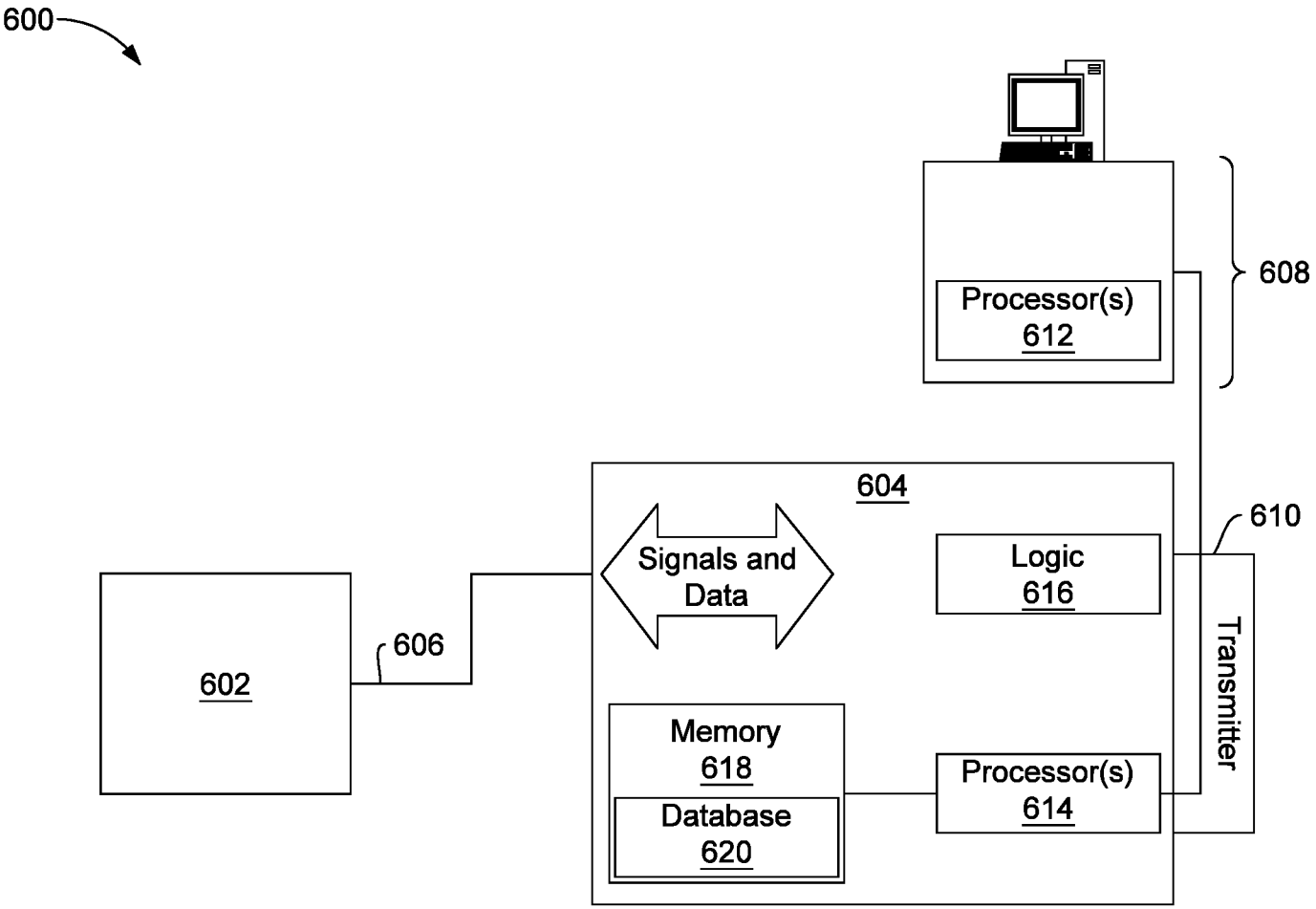
FIG. 6 is a schematic illustration of a shaker control system.

FIG. 6 illustrates a control system 600 which may be utilized with any of the shakers presented in previous FIGS. 1-5*b*. Control system 600 may include data acquisition system 604 which may be operatively coupled to shaker 602 via data link 606. Data link 606 may include any form of wired or wireless telecommunication such as, but not limited to, wires, fiber optics, or wireless means (e.g., radio frequency, etc.). Data link 606 may be utilized to transmit and receive data from shaker 602 and data acquisition system 604 to monitor and control the operation of shaker 602. For example, any of the previously mentioned pumps, venturis, eductors, valves, pressure sensors, load cells, or force transducers may transmit or receive data via data link 606 to data acquisition system 604. In some examples, the data acquisition system 604 may include and otherwise form part of a remote workstation 608. In further examples, the data acquisition system 604 may be configured to communicate with the remote workstation 608 via a transmitter 610, which may include any form of wired or wireless telecommunication such as, but not limited to, wires, fiber optics, or wireless means (e.g., radio frequency, etc.). In such examples, data may be transmitted to the remote workstation 608 to be processed with associated processors 612.

Data acquisition system 604 may include one or more processors 614 and logic 616 which may include a programmable data acquisition subsystem. Data acquisition system 604 may further include a memory 618 communicably coupled to the processor(s) 614 and used process, compile, or store data from shaker 602. Data acquisition system 604 may be generally characterized as a computer or computer system and the computer hardware associated with the data acquisition system 604, such as the processor(s) 614, may be used to implement the various methods and algorithms described herein. More particularly, the processor(s) 614 may be configured to execute one or more sequences of instructions, programming stances, or code stored on a non-transitory, computer-readable medium, such as the memory 618. The processor 614 can be, for example, a general purpose microprocessor, a microcontroller, a digital signal processor, an application specific integrated circuit, a field programmable gate array, a programmable logic device, a controller, a state machine, a gated logic, discrete hardware components, an artificial neural network, or any like suitable entity that can perform calculations or other manipulations of data. The memory 618 may comprise at least one of random access memory (RAM), flash memory, read only memory (ROM), programmable read only memory (PROM), and electrically erasable programmable read only memory (EEPROM). The memory 618 may further include one or more of registers, hard disks, removable disks, CD-ROMS, DVDs, or any other like suitable storage device or medium.

Executable sequences described herein can be implemented with one or more sequences of code contained in the memory 618. In some examples, such code can be read into the memory 618 from another machine-readable medium. Execution of the sequences of instructions contained in the memory can cause the processor 614 to perform the process steps described herein. As will be appreciated, one or more processors 614 in a multi-processing arrangement can also be employed to execute instruction sequences in the memory 618. In addition, hard-wired circuitry can be used in place of or in combination with software instructions to implement various embodiments described herein. Thus, the present disclosure is not limited to any specific combination of hardware and/or software.

Data acquisition system 604 may process data from shaker 602 and perform one or more functions in response to the processed data. For example, one or more signals from sensors on shaker 602 may be monitored and a control signal may be sent to shaker 602 in response to the one or more signals. Signals from pressure sensors or force transducers may be correlated to screen condition as discussed above. Data acquisition system 604 may send a signal to shaker 602 such that one or more air nozzles is directed to clear a screen blinding condition, for example. Other control signals may regulate valve positions to control vacuum generated, Accordingly, the present disclosure may provide methods and apparatus for improvements in shale shakers. The methods and apparatus may include any of the various features disclosed herein, including one or more of the following statements.

Statement 1. An apparatus comprising: a shaker body; a shaker screen disposed within the shaker body; and one or more air nozzles disposed within the shaker body, wherein the one or more air nozzles is positioned below the shaker screen to deliver a pressurized stream of air to at least a portion of a bottom of the shaker screen.

Statement 2. The apparatus of statement 1 wherein the apparatus comprises: a fluid inlet operable to receive a solid-laden drilling fluid; a first fluid outlet positioned below the shaker screen; and a second fluid outlet positioned above the shaker screen.

Statement 3. The apparatus of any of statements 1-2 further comprising a shaking system comprising motors operable to provide mechanical shaking motion to the shaker screen.

Statement 4. The apparatus of any of statements 1-3 wherein the one or more air nozzles are further operable to at least one of pivot and sweep.

Statement 5. The apparatus of any of statements 1-4 further comprising one or more additional air nozzles disposed within the shaker body, wherein the one or more additional air nozzles is positioned above the shaker screen to deliver a pressurized stream of air to at least a portion of a top of the shaker screen.

Statement 6. The apparatus of any of statements 1-5 further comprising at least one force transducer disposed within the shaker body wherein the at least one force transducer is positioned below the shaker screen.

Statement 7. The apparatus of statement 6 comprising a plurality of force transducers, wherein each of the plurality of force transducers is positioned below the shaker screen, and wherein each of the plurality of force transducers is operable to measure a force exerted by a fluid passing through the shaker screen.

Statement 8. An apparatus comprising: a shaker body; a shaker screen disposed within the shaker body; at least one fluid chute operatively connected to a bottom of the shaker screen; and a vacuum generator operable to generate a vacuum in the at least one fluid chute.

Statement 9. The apparatus of statement 8 wherein the vacuum generator is a pump fluidically connected to the at least one fluid chute.

Statement 10. The apparatus of any of statements 8-9 wherein the vacuum generator comprises one or more pumps, wherein the one or more pumps are individually fluidly connected to one or more fluid chutes, and wherein the one or more pumps are operable to provide different vacuum pressures across the shaker screen.

Statement 11. The apparatus of any of statements 8-10 wherein the vacuum generator comprise a venturi disposed within the at least one fluid chute and wherein the venturi is coupled to a source of compressed gas.

Statement 12. The apparatus of any of statements 8-11 wherein the compressed gas is at least one of air, nitrogen, carbon dioxide, or engine exhaust.

Statement 13. The apparatus of any of statements 8-12 wherein the vacuum generator comprises an eductor disposed within the at least one fluid chute.

Statement 14. The apparatus of any of statements 8-13 further comprising an eductor pump, wherein the vacuum generator comprises an eductor disposed within the at least one fluid chute, wherein an inlet to the eductor pump is fluidically connected to the at least one fluid chute, and wherein an outlet of the eductor pump is fluidically connected to and inlet of the eductor.

Statement 15. A method comprising: providing shaker comprising: a shaker body; a shaker screen disposed within the shaker body; and a sensor disposed within the shaker body; measuring a signal generated by the sensor; correlating the signal to a screen condition; and performing a screen operation based on the screen condition.

Statement 16. The method of statement 15 one or more air nozzles disposed within the shaker body, wherein the one or more air nozzles is positioned below the shaker screen to deliver a pressurized stream of air to at least a portion of a bottom of the shaker screen; wherein the sensor comprises a plurality of force transducers wherein each of the plurality of force transducers is positioned below the shaker screen; wherein the step of correlating the signal to the screen condition comprises correlating the signal to a screen blinding condition; and wherein the step of performing the screen operation comprises directing the one or more air nozzles to a portion of the shaker screen comprising the screen blinding condition.

Statement 17. The method of any of statements 15-16 wherein the shaker further comprises: two or more pumps, wherein the two or more pumps are individually fluidly connected to two or more fluid chutes which are operatively connected to a bottom of the shaker screen, and wherein the two or more pumps are operable to provide a vacuum pressure to a bottom of the shaker screen; wherein the sensor comprises a pressure transducer operatively coupled to the two or more fluid chutes; wherein the step of correlating the signal to the screen condition comprises correlating the signal to a screen blinding condition; and wherein the step of performing the screen operation comprises controlling the two or more pumps to change the vacuum pressure on the bottom of the shaker screen.

Statement 18. The method of any of statements 15-17 wherein the shaker further comprises: two or more venturis, wherein the two or more venturis are individually fluidly connected to two or more fluid chutes which are operatively connected to a bottom of the shaker screen, and wherein the two or more venturis are operable to provide a vacuum pressure to a bottom of the shaker screen; wherein the sensor comprises a pressure transducer operatively coupled to the two or more fluid chutes; wherein the step of correlating the signal to the screen condition comprises correlating the signal to a screen blinding condition; and wherein the step of performing the screen operation comprises controlling a flow of pressurized gas to the two or more venturis to change the vacuum pressure on the bottom of the shaker screen.

Statement 19. The method of any of statements 15-18 wherein the shaker further comprises: two or more eductors, wherein the two or more eductors are individually fluidly connected to two or more fluid chutes which are operatively connected to a bottom of the shaker screen, and wherein the two or more eductors are operable to provide a vacuum pressure to a bottom of the shaker screen; wherein the sensor comprises a pressure transducer operatively coupled to the two or more fluid chutes; wherein the step of correlating the signal to the screen condition comprises correlating the signal to a screen blinding condition; and wherein the step of performing the screen operation comprises controlling a flow of pressurized liquid to the two or more eductors to change the vacuum pressure on the bottom of the shaker screen.

Statement 20. The method of any of statements 15-19 wherein the shaker further comprises: two or more eductors, wherein the two or more eductors are individually fluidly connected to two or more fluid chutes which are operatively connected to a bottom of the shaker screen, and wherein the two or more eductors are operable to provide a vacuum pressure to a bottom of the shaker screen; and an eductor pump, wherein an inlet to the eductor pump is fluidically connected to the at to two or more fluid chutes, and wherein an outlet of the eductor pump is fluidically connected to and inlet of the two or more eductors and operable to provide a pressurized liquid to the two or more eductors; wherein the sensor comprises a pressure transducer operatively coupled to the two or more fluid chutes; wherein the step of correlating the signal to the screen condition comprises correlating the signal to a screen blinding condition; and wherein the step of performing the screen operation comprises controlling a flow of the pressurized liquid to the two or more eductors to change the vacuum pressure on the bottom of the shaker screen.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure. If there is any conflict in the usages of a word or term in this specification and one or more patent(s) or other documents that may be incorporated herein by reference, the definitions that are consistent with this specification should be adopted.

What is claimed is:

1. A method comprising:

providing a shaker comprising:

a shaker body;

a shaker screen disposed within the shaker body;

a sensor disposed within the shaker body, wherein the sensor comprises a plurality of force transducers and wherein each of the plurality of force transducers is positioned below the shaker screen; and one or more air nozzles disposed within the shaker body, wherein the one or more air nozzles is positioned below the shaker screen to deliver a pressurized stream of air to at least a portion of a bottom of the shaker screen;

measuring a signal generated by the sensor;

correlating the signal to a screen condition, wherein the step of correlating the signal to the screen condition comprises correlating the signal to a screen blinding condition; and performing a screen operation based on the screen condition, wherein the step of performing the screen operation comprises directing the one or more air nozzles to a portion of the shaker screen comprising the screen blinding condition.

2. The method of claim 1, wherein the directing of the one or more air nozzles comprises at least one movement selected from the group consisting of a pivot, a sweep, or a combination thereof.

3. The method of claim 1, wherein the one or more air nozzles comprises at least one pneumatic device.

4. The method of claim 1 further comprising monitoring the signal with a control system comprised of one or more processors and a memory.

5. The method of claim 4, wherein the monitoring comprises at least one of transmitting data between the control system and a circuit component, receiving data between the control system and the circuit component, and any combination thereof, wherein the circuit component comprises a component selected from the group consisting of: pumps, venturi, eductors, valves, pressure sensors, load cells, force transducers, and any combination thereof.

6. The method of claim 4, wherein the one or more processors comprise at least one processor selected from a list consisting of: a general-purpose microprocessor, a microcontroller, a digital signal processor, an application specific integrated circuit, a field programmable gate array, a programmable logic device, a controller, a state machine, a gated logic, discrete hardware components, an artificial neural network, and any combination thereof.

7. The method of claim 1 further comprising a data transmission to transmit data to a remote workstation, wherein the data transmission comprises at least one data transmission selected from the group consisting of wireless telecommunications, wired telecommunications, or combinations thereof.

8. The method of claim 1, wherein the signal comprises at least one signal selected from the group consisting of a null signal, a saturated signal, a decreased stable, a stable signal, and combinations thereof.

9. A method comprising:

providing a shaker comprising:

a shaker body;

a shaker screen disposed within the shaker body;

two or more pumps, wherein the two or more pumps are individually fluidically connected to two or more fluid chutes which are operatively connected to a bottom of the shaker screen, and wherein the two or more pumps are operable to provide a vacuum pressure to the bottom of the shaker screen; and a sensor disposed within the shaker body, wherein the sensor comprises a pressure transducer operatively coupled to the two or more fluid chutes;

measuring a signal generated by the sensor;

correlating the signal to a screen condition, wherein the step of correlating the signal to the screen condition comprises correlating the signal to a screen blinding condition; and performing a screen operation based on the screen condition, wherein the step of performing the screen operation comprises controlling the two or more pumps to change the vacuum pressure on the bottom of the shaker screen.

10. The method of claim 9 further comprising monitoring the signal with a control system comprised of one or more processors and a memory.

11. The method of claim 9, wherein the signal comprises at least one signal selected from the group consisting of a null signal, a saturated signal, a decreased signal, a stable signal, and combinations thereof.

12. A method comprising:

providing a shaker comprising:

a shaker body;

a shaker screen disposed within the shaker body;

two or more venturis, wherein the two or more venturis are individually fluidically connected to two or more fluid chutes which are operatively connected to a bottom of the shaker screen, and wherein the two or more venturis are operable to provide a vacuum pressure to the bottom of the shaker screen; and a sensor disposed within the shaker body, wherein the sensor comprises a pressure transducer operatively coupled to the two or more fluid chutes;

measuring a signal generated by the sensor;

correlating the signal to a screen condition, wherein the step of correlating the signal to the screen condition comprises correlating the signal to a screen blinding condition; and performing a screen operation based on the screen condition, wherein the step of performing the screen operation comprises controlling a flow of pressurized gas to the two or more venturis to change the vacuum pressure on the bottom of the shaker screen.

13. The method of claim 12 further comprising monitoring the signal with a control system comprised of one or more processors and a memory.

14. The method of claim 12, wherein the source of compressed gas comprises at least one compressed gas selected from a group consisting of: air, nitrogen, carbon dioxide, engine exhaust, or any combination thereof.

15. The method of claim 12, wherein the signal comprises at least one signal selected from the group consisting of a null signal, a saturated signal, a decreased stable, a stable signal, and combinations thereof.

16. A method comprising:

providing a shaker comprising:

a shaker body;

a shaker screen disposed within the shaker body;

two or more eductors, wherein the two or more eductors are individually fluidly connected to two or more fluid chutes which are operatively connected to a bottom of the shaker screen, and wherein the two or more eductors are operable to provide a vacuum pressure to the bottom of the shaker screen; and a sensor disposed within the shaker body, wherein the sensor comprises a pressure transducer operatively coupled to the two or more fluid chutes;

measuring a signal generated by the sensor;

correlating the signal to a screen condition, wherein the step of correlating the signal to the screen condition comprises correlating the signal to a screen blinding condition; and performing a screen operation based on the screen condition, wherein the step of performing the screen operation comprises controlling a flow of pressurized liquid to the two or more eductors to change the vacuum pressure on the bottom of the shaker screen.

17. The method of claim 16 further comprising monitoring the signal with a control system comprised of one or more processors and a memory.

18. The method of claim 16, wherein the signal comprises at least one signal selected from the group consisting of a null signal, a saturated signal, a decreased stable, a stable signal, and combinations thereof.

19. A method comprising:

providing a shaker comprising:

a shaker body;

a shaker screen disposed within the shaker body;

two or more eductors, wherein the two or more eductors are individually fluidly connected to two or more fluid chutes which are operatively connected to a bottom of the shaker screen, and wherein the two or more eductors are operable to provide a vacuum pressure to the bottom of the shaker screen;

a sensor disposed within the shaker body wherein the sensor comprises a pressure transducer operatively coupled to the two or more fluid chutes; and an eductor pump, wherein an inlet to the eductor pump is fluidically connected to the two or more fluid chutes, and wherein an outlet of the eductor pump is fluidically connected to an inlet of the two or more eductors and operable to provide a pressurized liquid to the two or more eductors;

measuring a signal generated by the sensor;

correlating the signal to a screen condition, wherein the step of correlating the signal to the screen condition comprises correlating the signal to a screen blinding condition; and performing a screen operation based on the screen condition, wherein the step of performing the screen operation comprises controlling a flow of the pressurized liquid to the two or more eductors to change the vacuum pressure on the bottom of the shaker screen.

20. The method of claim 19, wherein the signal comprises at least one signal selected from the group consisting of a null signal, a saturated signal, a decreased stable, a stable signal, and combinations thereof.

* * * * *